US006802588B2

(12) United States Patent
Garbacz et al.

(10) Patent No.: US 6,802,588 B2
(45) Date of Patent: Oct. 12, 2004

(54) FLUID JET APPARATUS AND METHOD FOR CLEANING INKJET PRINTHEADS

(75) Inventors: Gregory J. Garbacz, Rochester, NY (US); Gilbert A. Hawkins, Mendon, NY (US); Michael Long, Hilton, NY (US); John Sechrist, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 50 days.

(21) Appl. No.: 10/228,647

(22) Filed: Aug. 26, 2002

(65) Prior Publication Data

US 2004/0036735 A1 Feb. 26, 2004

(51) Int. Cl.[7] ..... B41J 2/165
(52) U.S. Cl. ..... 347/28
(58) Field of Search ..... 347/10, 11, 14, 347/21, 22, 25, 26, 27, 28, 29, 35

(56) References Cited

U.S. PATENT DOCUMENTS 4,746,938 A * 5/1988 Yamamori et al. ..... 347/28
5,300,958 A 4/1994 Burke et al.
5,495,272 A * 2/1996 Yamaguchi ..... 347/28
5,907,335 A 5/1999 Johnson et al.
6,158,838 A * 12/2000 Capurso ..... 347/28
6,193,353 B1 2/2001 Vives et al.
6,196,657 B1 * 3/2001 Hawkins et al. ..... 347/28
6,224,191 B1 * 5/2001 Saito et al. ..... 347/48

* cited by examiner

*Primary Examiner*—Shih-Wen Hsieh
(74) *Attorney, Agent, or Firm*—Milton S. Sales

(57) ABSTRACT

Both a cleaning fluid jet apparatus and method for cleaning an array of inkjet nozzles in a printhead is provided. The fluid jet apparatus includes a cleaning head having an array of cleaning nozzles registrable with the array of inkjet nozzles in the printhead, and a mounting assembly that mounts the cleaning head in opposition to the printhead with the cleaning nozzles in substantial alignment with the inkjet nozzles. A supply of pressurized cleaning fluid is connected to the cleaning nozzles such that the cleaning nozzles discharge a stream of high velocity cleaning droplets that impinges the inkjet nozzles. Both a droplet sizing mechanism and a droplet speed controller are provided so that the size, frequency, and velocity of the cleaning droplets may be selected for maximum cleaning efficiency. The apparatus also includes a mechanism for changing a location of cleaning droplet impingement so that both the inkjet nozzles and the areas immediately surrounding the nozzles may be effectively cleaned.

33 Claims, 10 Drawing Sheets

FLUID JET APPARATUS AND METHOD FOR CLEANING INKJET PRINTHEADS

BACKGROUND OF THE INVENTION

This invention generally relates to devices and methods for cleaning the inkjet nozzles of an inkjet printhead, and is specifically concerned with a fluid jet device that cleans such inkjet nozzles by means of a stream of small, high velocity fluid droplets discharged from a cleaning head mounted in opposition to the printhead.

Devices for cleaning the nozzles of either drop-on-demand or continuous inkjet nozzles in a printhead are known in the prior art. Such devices are necessary, as dried ink deposits and other debris tend to accumulate around the orifices of the inkjet nozzles over time. Such deposits and debris may ultimately interfere with the ability of the printhead to achieve high resolution printing by either deflecting the intended trajectory of the ink droplets discharged from the nozzles, or, in extreme cases, blocking the orifices of the nozzles altogether.

In many of these prior art devices, a printhead wiper cleans the nozzle surfaces via a mechanical wiping action. Cleaning solvent is applied either to the wiper itself, or onto the surface of the printhead prior to the wiping operation. In another type of prior art cleaning device, cleaning solution is either oscillated or discharged directly through the nozzles of the inkjet printhead itself. In some prior art devices, the printing ink itself is used as a cleaning solvent prior to the initiation of a printing operation to simplify the cleaning operation.

While mechanical wiping techniques are effective in the removal of contaminants, they also reduce the lifetime of the printhead due to mechanical wear. They are further time consuming and consequently reduce printer productivity. Even in prior art devices where the cleaning fluid is applied without direct mechanical contact to the printhead (as, for example, via a spray nozzle), such application alone is not effective in dislodging and removing the deposits and debris around the inkjet nozzles, and the use of a mechanical wiper is necessary to complete the cleaning operation. Moreover, in all such prior art cleaning devices, no attempt is made to restrict the application of the cleaning fluid to the bore of the nozzles. Consequently, the entire printhead surface (and possibly other portions of the printer) are completely covered with a cleaning solution, which is not only unnecessary and wasteful, but potentially damaging to fragile and sensitive mechanical and electrical components on and around the printhead.

In prior art cleaning devices where the ink itself is the cleaning fluid and is either oscillated within the nozzle or ejected from it, optimal cleaning is not easily achieved due to the fact that neither an oscillatory or a continuously streaming fluid provides much dislodgment force on the contaminants and debris on the interior surfaces of the nozzle. In cases where a cleaning fluid other than ink is used, the cleaning fluid must be completely purged from the printhead and the printhead must be refilled with ink after the cleaning operation. In all cases where the cleaning fluid is ejected from the inkjet nozzles themselves, a large volume of cleaning fluid (whether ink or a special cleaning solution) is necessary.

Clearly, there is a need for a cleaning technique that avoids the mechanical wear associated with wiping techniques, and the waste and ineffectiveness associated with techniques which oscillate or eject cleaning fluids through the inkjet nozzles themselves. Ideally, such a technique would concentrate the cleaning action on or around the inkjet nozzles themselves in order to conserve cleaning fluid, and to eliminate contact between the cleaning fluid and fragile electronic and mechanical components located near the vicinity of the inkjet nozzles. Finally, such a technique should be adaptable to both drop-on-demand and continuous inkjet printers, and rapid in operation in order to minimize printing downtime.

SUMMARY OF THE INVENTION

Generally speaking, the invention is a fluid jet apparatus and method that cleans the inkjet nozzles of a printhead without the aforementioned shortcomings associated with the prior art. To this end, the fluid jet apparatus of the invention comprises a cleaning head having an array of cleaning nozzles registrable with the array of inkjet nozzles in the printhead, a mounting assembly that mounts the cleaning head in opposition to the printhead with the cleaning nozzles in substantial alignment with the inkjet nozzles, and a supply of pressurized fluid connected to the cleaning nozzles such that the cleaning nozzles discharge a stream of fluid droplets that impinge on the inkjet nozzles, wherein at least some of the droplets are about the same size as the orifices of the printhead nozzles. The fluid jet apparatus preferably includes a droplet sizing mechanism that controls the size of the cleaning droplets discharged by the cleaning nozzles. Such a droplet sizing mechanism may have a plurality of electrical resistance heaters adjacent to each of the cleaning nozzles for applying heat pulses at different frequencies to the stream of fluid discharged thereby to thermally "pinch" the stream into droplets of a desired size.

The fluid jet apparatus may further have a droplet speed controller that controls the velocity and frequency of solvent droplets discharged by the cleaning nozzle. The supply of pressurized fluid may include a fluid pump and the droplet speed controller may include a circuit for controlling the amount of pressure that the pump generates in fluid connected to the cleaning nozzles.

The fluid jet apparatus may also comprise a mechanism for changing a location of impingement of the cleaning droplets with respect to the inkjet nozzles of the printhead. Such a location mechanism may include a cleaning head moving assembly for oscillating the cleaning head relative to the printhead. In another embodiment of the invention, the locating changing mechanism may include a cleaning droplet deflector that deflects a path of cleaning droplets as they are discharged from the cleaning nozzles. Such a deflector may take the form of electrical resistance heaters positioned adjacent to each of the cleaning nozzles for asymmetrically applying heat pulses to the stream of cleaning droplets discharged by the cleaning nozzles. In another embodiment, the location changing mechanism may include a device for generating a fluid stream, such as a stream of air, that traverses the path of the cleaning droplets. The flow rate of the fluid stream varies over time to different areas of the nozzles in order to deflect the cleaning droplets.

The fluid jet apparatus also preferably includes a cleaning fluid reclamation system. Such a system may include a gutter for collecting liquid cleaning fluid that impinges and runs off of the inkjet nozzles of the printhead. The reclamation system may further include a pump for generating a negative pressure in the inkjet nozzles during a cleaning operation such that at least some of the cleaning droplets are sucked into the inkjet nozzles and directed back into a reclamation reservoir.

In operation, the fluid jet apparatus discharges discrete droplets of cleaning fluid of controlled size and high velocity in and around the orifices of the inkjet nozzles. At least some of the droplets are about the same size as the printhead nozzle orifices. The trajectory of the cleaning droplets may be varied during cleaning by oscillating the cleaning head, applying asymmetric thermal pulses or applying a time-varying fluid stream across the droplets so that droplets impinge on different areas of the printhead nozzles. The cleaning droplets may be discharged continuously during the cleaning operation, or on demand by conducting individual slugs of cleaning fluid to the cleaning head between pulses of compressed air to conserve cleaning fluid. In all cases, the resulting high velocity impingement of small individual cleaning droplets provides a highly effective cleaning action with a minimum amount of cleaning fluid that sharply focuses the cleaning action on the nozzle orifices themselves, and in areas immediately surrounding them, thereby preventing other potentially sensitive areas of the printhead from being unnecessarily exposed to the cleaning fluid.

BRIEF DESCRIPTION OF THE DRAWINGS

FIGS. 3A and 3B illustrate different types of orifice plates for inkjet printheads, while

DETAILED DESCRIPTION OF THE PREFERRED EMBODIMENTS

Figure 1A:
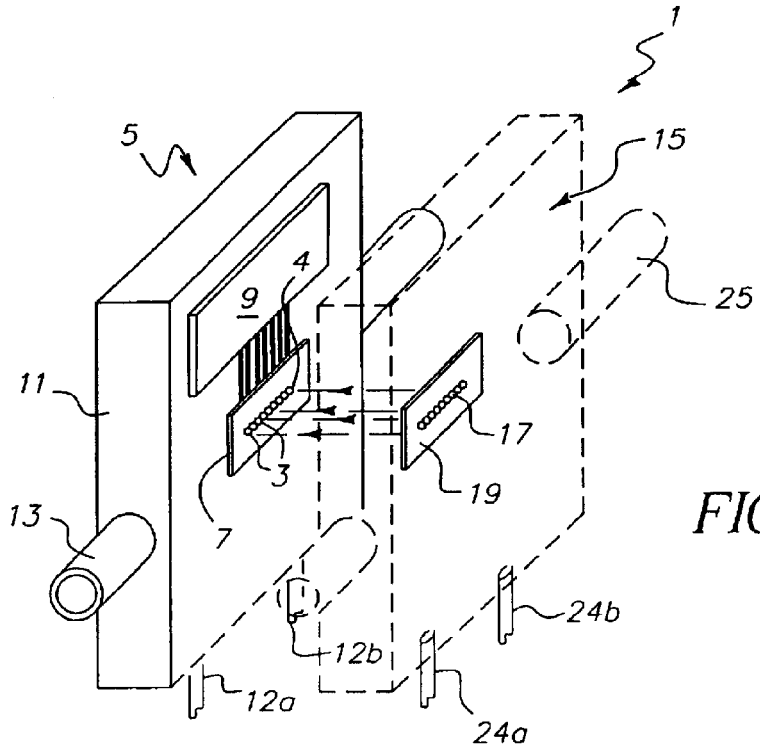
FIG. 1A is a perspective view of the fluid jet device (shown in phantom) performing a cleaning operation on an inkjet printhead.
Figure 1B:
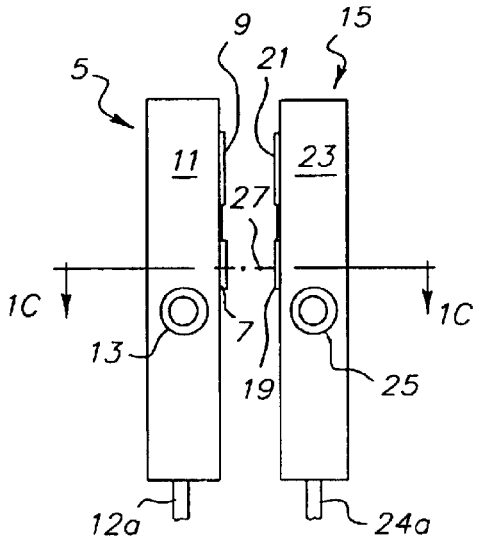
FIG. 1B is a side view of the cleaning head and inkjet printhead illustrated in FIG. 1A.
Figure 1C:
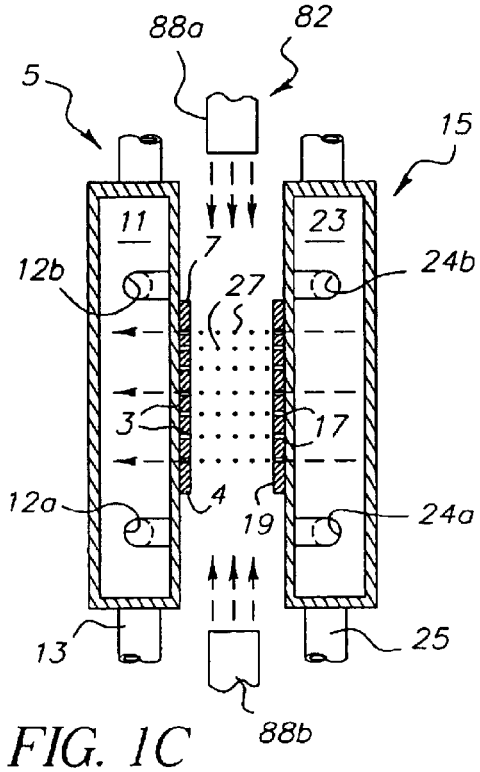
FIG. 1C is a cross-sectional plan view of the cleaning head and printhead illustrated in FIG. 1B along the line 1*c*—1*c;*

With reference now to FIGS. 1A, 1B, and 1C, wherein like components are designated by like reference numerals throughout all of the several Figures, the purpose of the fluid jet device 1 of the invention is to clean to inkjet nozzles 3 of inkjet printhead 5. Each of these nozzles 3 includes an orifice 4 located in an orifice plate 7. A circuit board 9 mounted adjacent to the orifice plate 7 generates electrical signals which serve either to size or deflect the ink droplets generated by the nozzles 4 or to actuate the individual generation of such ink drops, depending upon whether the printhead 5 is a continuous or drop-on-demand type printhead. Both the orifice plate 7 and circuit board 9 are mounted onto the rectangular housing 11 of the printhead 5. An inlet 12*a* and outlet 12*b* is provided on the bottom of the housing 11 for circulating a flow of ink through the printhead 5. The housing 11 of the printhead 5 is movably connected to a mounting assembly 13 for reciprocatory motion with respect to a print medium (not shown).

The cleaning head 15 includes an array of cleaning nozzles 17 mounted in an orifice plate 19 as shown. Similar to the printhead 5, a circuit board 21 is provided adjacent to the orifice plate 19 for generating electrical signals which may either control the size of the cleaning droplets generated by the nozzles 17, or operate to steer the droplets so that they impinge on different areas on and around the inkjet nozzles 3. Both the orifice plate 19 and circuit board 21 are mounted on a rectangular housing 23 having an inlet 24*a* and an outlet 24*b* for circulating a flow of cleaning fluid. As is most evident in FIGS. 1A and 1C, the cleaning nozzles 17 present in the orifice plate 19 are a precise mirror image of the inkjet nozzles 3 present in the orifice plate 7 so that there exists a one-to-one alignment between the inkjet nozzles 3 and cleaning nozzles 17 when the printhead 5 and cleaning head 15 are opposed to one another. The cleaning head 15 is connected to a mounting assembly 25 which allows such a one-to-one nozzle alignment to occur.

Figure 2A:
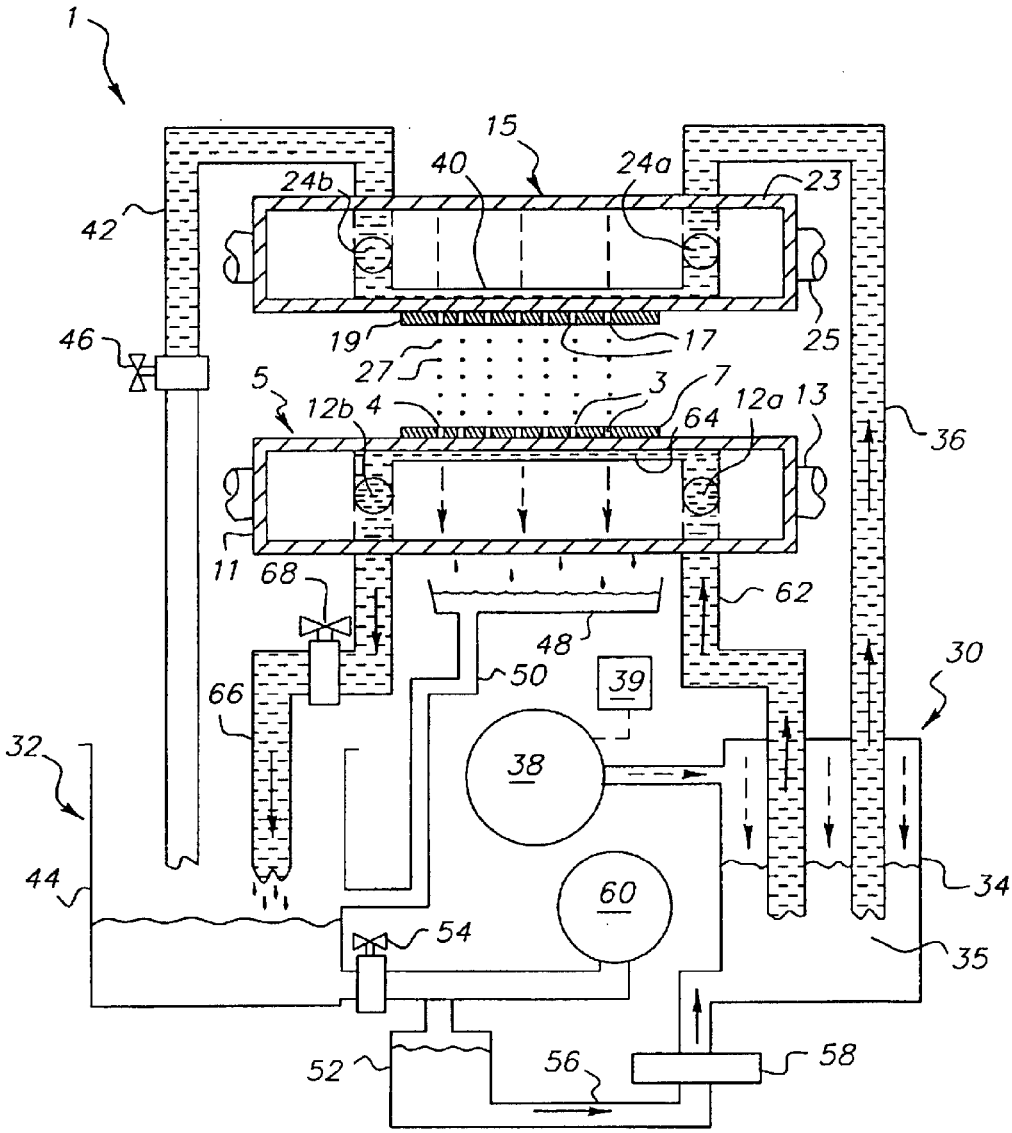
FIG. 2A is a schematic plan view of the fluid jet device of the invention performing a cleaning operation on a printhead in a continuous cleaning droplet mode.

FIG. 2A schematically illustrates a first embodiment of the fluid jet device 1 of the invention wherein the cleaning head 15 continuously generates cleaning droplets 27 that impinge on the orifices 4 of the inkjet nozzles 3 of a printhead 5. In this embodiment, a supply of pressurized cleaning fluid 30 is connected to the inlet 24*a* of the cleaning head 15. A cleaning fluid reclamation system 32 is connected to the fluid outlet 24*b* of the cleaning head 15. The pressurized cleaning fluid supply 30 includes a closed vessel 34 that contains an inventory of cleaning fluid 35.

In this preferred embodiment, the cleaning fluid 35 is the same ink used by the inkjet printhead 5, since such ink has proven to be a highly effective cleaning solvent for the removal of dried ink and other debris from the nozzles 3. The use of ink as a cleaning solvent also allows the printhead 5 and the cleaning heat 15 to use the same fluid supply 30 and reclamation system 32. However, other cleaning fluids may be used, including non-ink cleaning solvents, and even particulate materials such as fine particles of dry ice entrained in a stream of compressed air.

An inlet conduit 36 connects the cleaning fluid 35 and the vessel 34 where the inlet conduit 24*a* of the cleaning head 15. A pump having an outlet connected to the upper end of the closed vessel 34 pressurizes the vessel so that cleaning fluid 35 is forced through the conduit 36 into the cleaning head inlet 24*a*. A droplet speed controller in the form of a pressure controller 39 regulates the pump 38 to vary the pressure within the vessel 34 in order to control the velocity of the cleaning droplets discharged from the cleaning nozzles 17. A distribution plate 40 uniformly distributes the pressurized cleaning fluid to each of the cleaning nozzles 17. Cleaning fluid that is not discharged through the nozzles 17 is collected in the outlet 24*b*, which in turn is connected to the outlet conduit 42. The end of the outlet conduit 42 is disposed within an open collection vessel 44 of the cleaning fluid reclamation system 32.

A control valve 46 mounted in the outlet conduit 42 determines whether or not cleaning fluid forced through the inlet conduit 36 will flow through the cleaning nozzles 17, or merely circulate through the distribution plate 40, the outlet conduit 42, and into the collection vessel 44. The reclamation system 32 also includes a gutter 48 for collecting droplets of cleaning fluid that drip from the orifice plate 7 of the printhead 5. Any such cleaning fluid collected by the gutter 48 flows into the collection vessel 44 via drain conduit 50. Finally, the reclamation system 32 includes a drain vessel 52 connected to the bottom of the collection vessel 44 by way of a drain valve 54. A conduit 56 connects the drain vessel 52 to the cleaning fluid supply vessel 34 via a filter 58. A recycling pump 60 supplies pressurized air to the upper end of the drain vessel 52 to force reclaimed cleaning fluid through the filter 58 and back into vessel 34.

As previously indicated, one advantage of using printhead ink as the cleaning fluid 35 is that the same fluid supply 30 and reclamation system 32 may be used to supply ink to the printhead 5 when the cleaning head 15 is removed from its opposing position after a cleaning operation has been performed. Still another advantage is that the same supply 30 and reclamation system 32 may be used to circulate ink through the printhead 5 in a "back flush" mode of operation in order to generate a small negative pressure in the nozzles 3 which effectively sucks the cleaning droplets 27 down the various orifices 4 where they may be directed into the collection vessel 34. To this end, the inlet 12*a* of the printhead 5 is connected to the ink being used as a cleaning fluid 35 via inlet conduit 62. A distribution plate 64 connects the inlet 12*a* to the outlet 12*b*. Outlet 12*b* is in turn connected to the collection vessel 44 via outlet conduit 66. When back flush valve 68 located in outlet 66 is open (as is shown in FIG. 2A), the ink used as the cleaning fluid 35 will circulate from the inlet 12*a* to the outlet 12*b* through the distribution plate 64 without being ejected through the nozzles 3 due to the larger flow path (and consequent lower fluid resistance) offered by the orifice plate 64 versus the nozzles 3 of the orifice plate 7. Because lower pressures are generated in areas immediately surrounding the flow of a moving fluid via Bernoulli's principal, a small amount of negative pressure will be generated in the orifices 4 of the printhead nozzles 3.

Figure 2B:
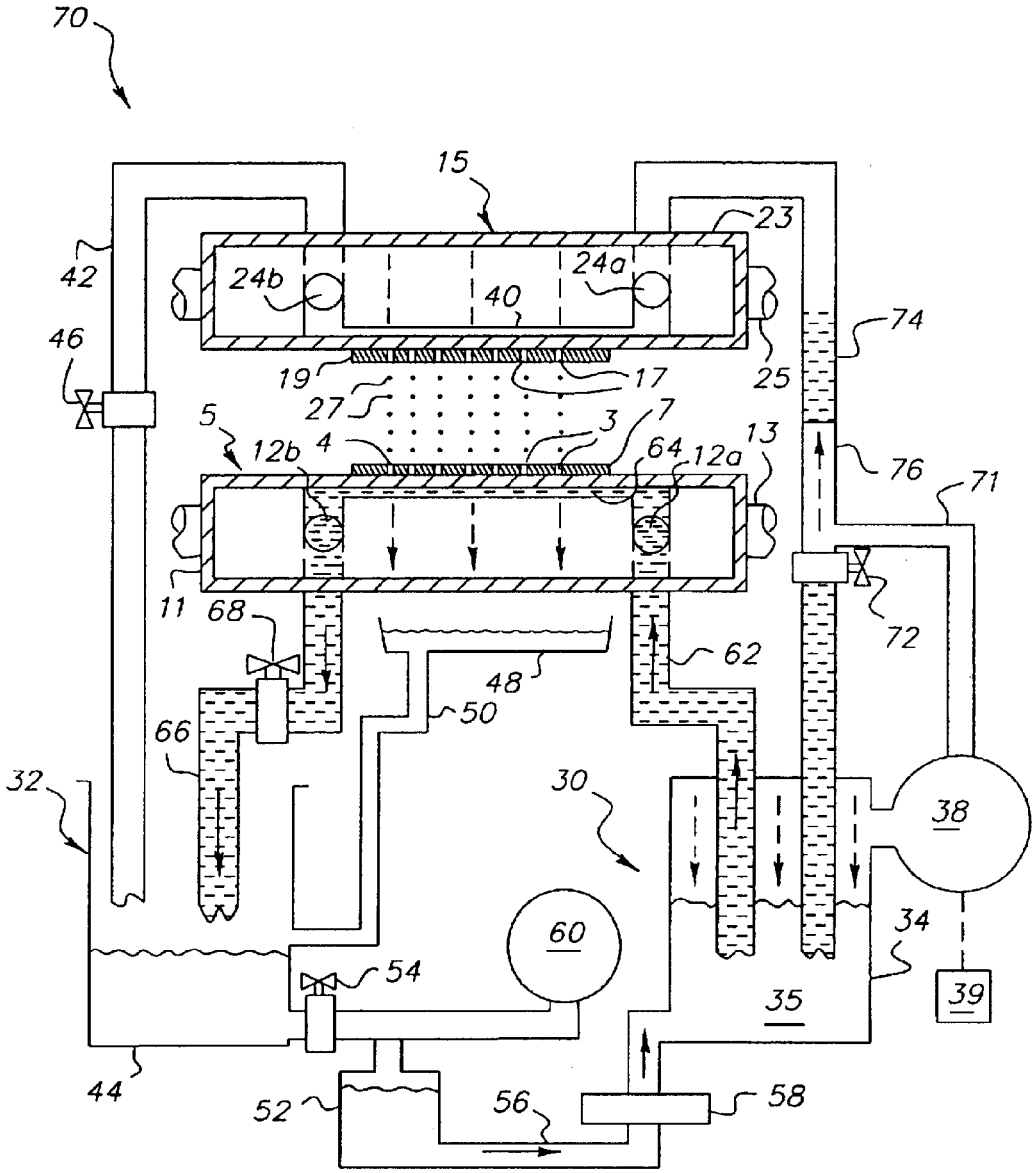
FIG. 2B is an alternative embodiment of the fluid jet device of the invention which, in contrast to the embodiment illustrated in FIG. 2A, is capable of a drop-on-demand type cleaning mode.

In operation, the pump 38 of the fluid supply 30 is actuated while control valve 46 is closed. The printhead may be of any type. As shown printhead 5 contains a return fluid path 66. It is not necessary to have a return path of fluid and conduit 66 or valve 68 as shown in FIGS. 2A and 2B. The pressure generated by the pump 38 forces the ink used as cleaning fluid 35 through the inlet conduit 36 and out through the nozzles 17 of the cleaning head 15. At the same time, back flush valve 68 of the outlet conduit 66 of printhead 5 is opened so that the ink used as the cleaning fluid 35 circulates through the printhead 5 as previously described. Operation of valve 68 can be in both the closed and open positions. Fluid in the printhead 5 will be directed out of the nozzles 3 if the valve 68 is closed. Cleaning droplets 27 that impinge directly in and around the orifices 4 of the inkjet nozzles 3 are sucked into the circulating flow of ink through the printhead 5. Both the back flushed cleaning fluid and the collected cleaning droplets 27 are discharged through the outlet conduit 66, where they are collected in the vessel 44 of the reclamation system 32. Periodically, drain valve 54 is opened to allow a flow of the ink used as a cleaning fluid into the drain vessel 52. Recycling pump 60 is then actuated, forcing the ink used as cleaning fluid through the drain conduit 56, the filter 58, and back into the closed vessel 34.

FIG. 2B illustrates an alternative embodiment 70 of the fluid jet device which is identical in all respects to the embodiment 1 illustrated in FIG. 2A, with two exceptions. First, an auxiliary pump outlet 71 is provided between the cleaning fluid supply pump 38 and the inlet conduit 36. Second, a modulation valve 72 is provided between one end of the inlet conduit 36 and the joint between the auxiliary pump outlet 71 and the balance of the inlet conduit 36. Such an arrangement allows an individual slug 74 of cleaning fluid to be introduced into the inlet conduit 36 by the rapid opening and closing of the modulation valve 72. Thereafter, a flow of compressed air 76 generated by the pump 38 propels the slug 74 through cleaning head inlet 24*a*, distribution plate 40, and out through the cleaning head nozzles 17, as control valve 46 is closed during such a cleaning operation. In all other ways, this alternative embodiment 70 operates in the same manner as described with respect to the first embodiment 1, the only difference being that a smaller amount of cleaning fluid 35 is used. As such, the embodiment 70 of the invention illustrated in FIG. 2B operates more analogously to a drop-on-demand printhead, in contrast to the continuous drop operation described with respect to the embodiment 1 illustrated in FIG. 2A.

Figure 3A:
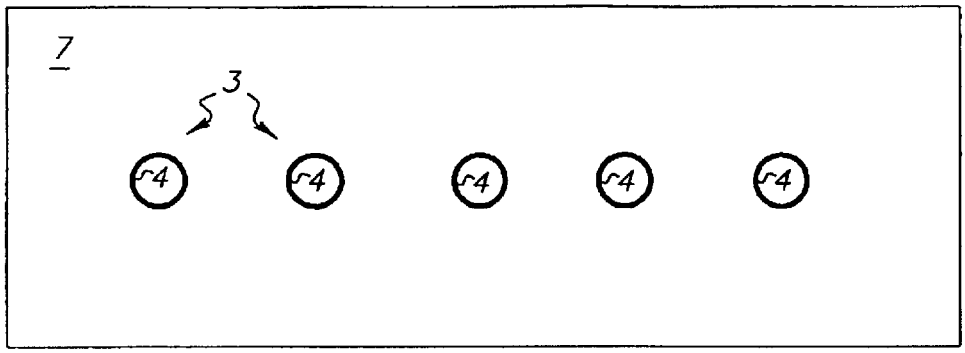
Figure 3B:
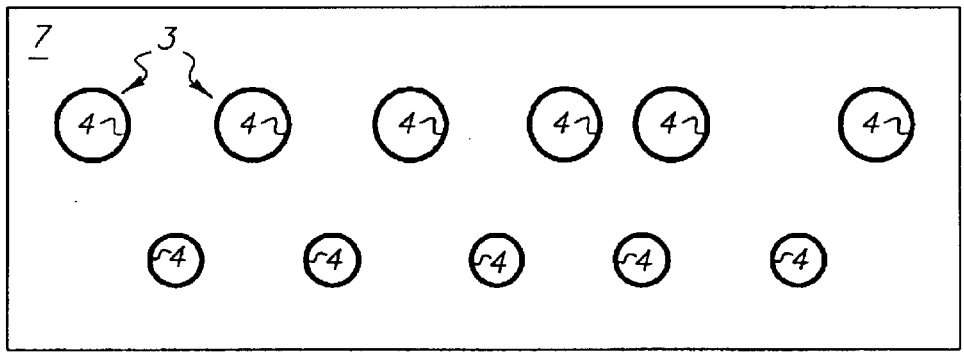
Figure 3C:
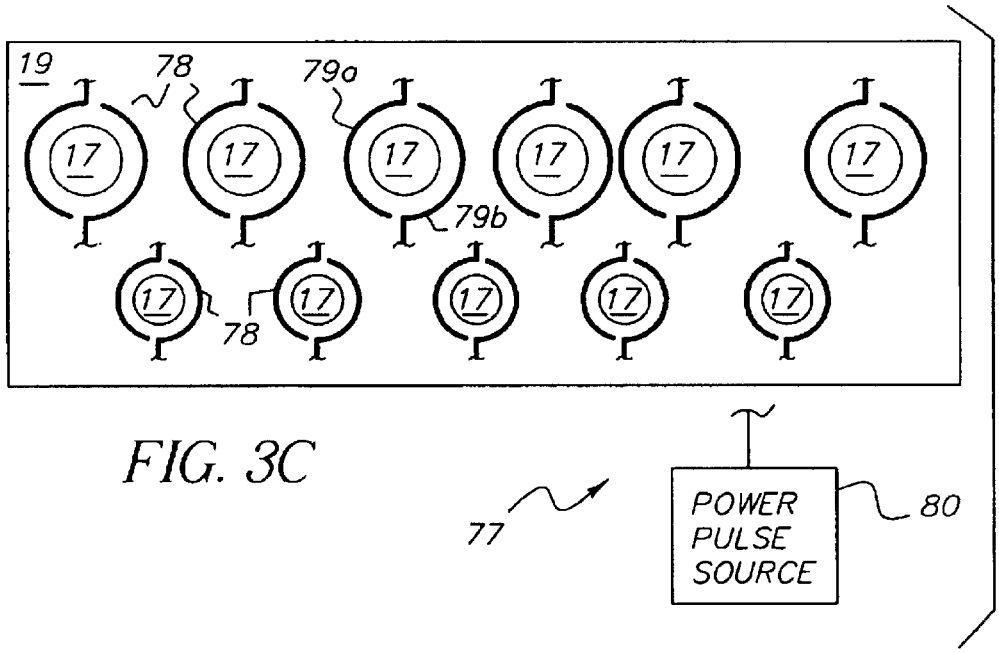
FIG. 3C is an orifice plate for the cleaning head of the invention having cleaning jets which are registrable with the inkjets of the printhead illustrated in FIG. 3B.

With reference now to FIGS. 3A, 3B, and 3C, the orifice plate 7 of the printhead 5 may include an array of inkjet nozzles 3 which are all the same size, and uniformly spaced. Alternatively, as is illustrated in FIG. 3B, the inkjet nozzles 3 may be of different sizes and non-uniformly spaced. In either case, the cleaning nozzles 17 of the cleaning head 15 should reflect the same size and spacing as the nozzles 3 of the printhead 5 in mirror symmetry in the same fashion that the cleaning nozzles 17 illustrated in FIG. 3C correspond with the inkjet printing nozzles 3 illustrated in FIG. 3B.

Figure 4A:
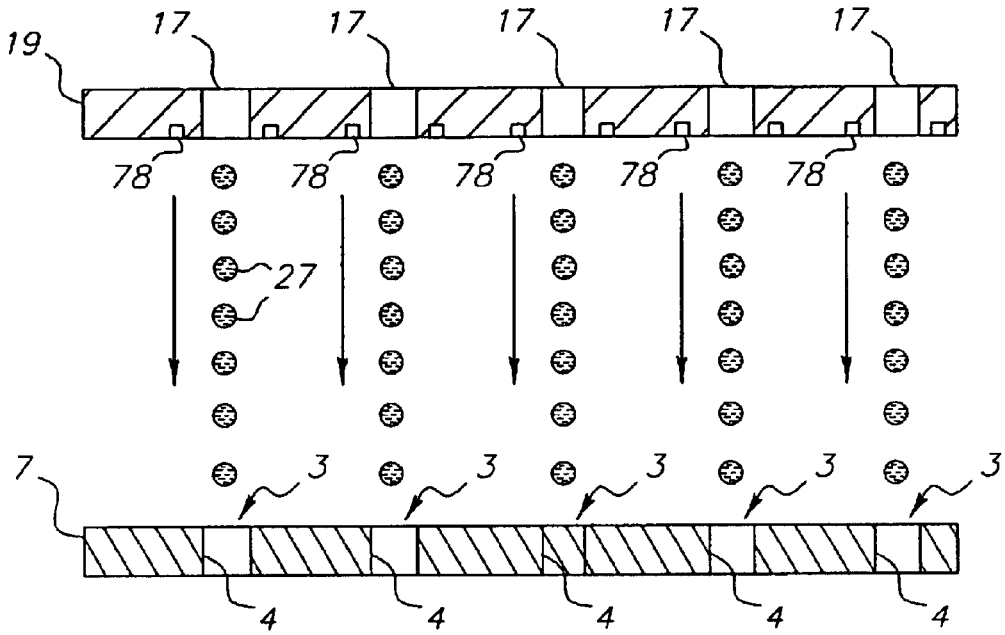
FIG. 4A is a plan, cross-sectional view of the orifice plate of the cleaning head performing a cleaning operation on the orifice plate of a printhead using cleaning droplets of uniform size which are slightly smaller than the nozzles of the printhead.
Figure 4B:
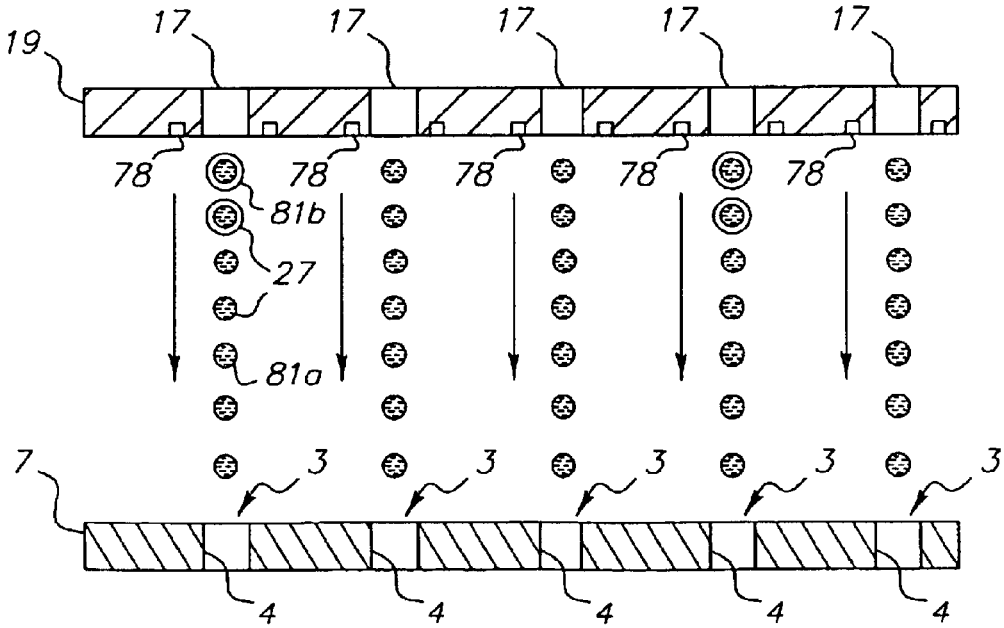
FIG. 4B is a plan, cross-sectional view of the orifice plates of the cleaning head and a printhead wherein the droplet sizing mechanism of the cleaning head generates cleaning droplets of which are both larger and smaller than the printhead nozzle orifices.
Figure 5A:
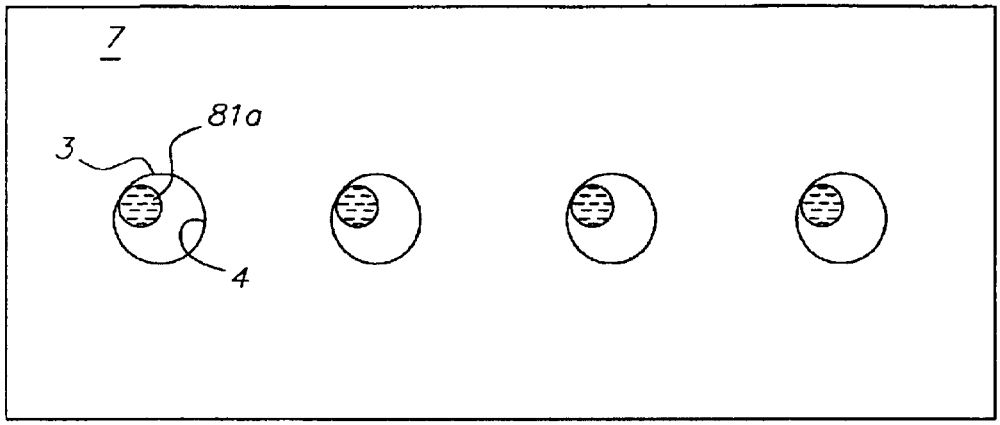
FIGS. 5A and 5B illustrate the cleaning effect on the orifice plate of the printhead of the different sized drops generated in FIG. 4B.
Figure 5B:
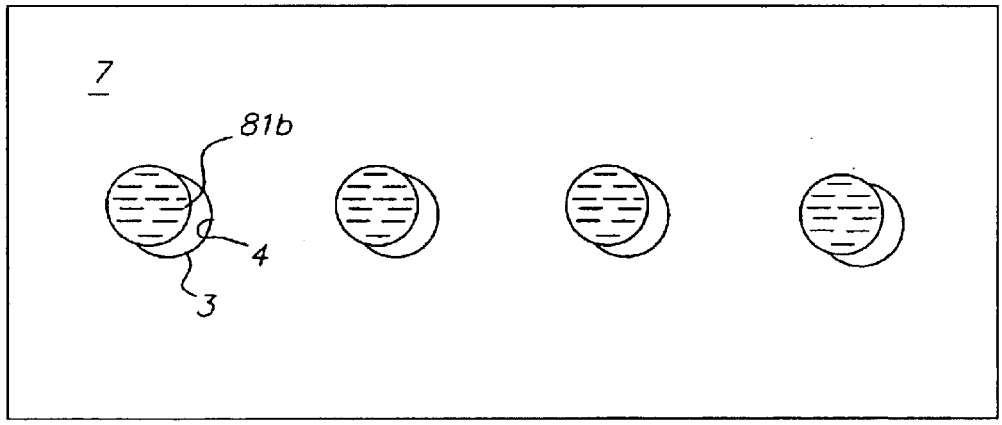

As previously mentioned, both embodiments 1 and 70 of the invention include a droplet speed controller in the form of a pressure controller 39 which is operably connected to the pump 35 of the cleaning fluid supply 30. As shown in FIG. 3C, both of these embodiments 1, 70 further include a droplet sizing mechanism 77 in the form of annular heaters 78 circumscribing each of the cleaning nozzles 17 in combination with a power pulse source 80 connected to each of the heaters 78. Each of the heaters 78 includes two semi-annular heaters 79*a*, 79*b*, each of which is separately connected to the power pulse source 80. In operation, the power pulse source 80 supplies pulses of electrical current to both halves of the annular heater 78 surrounding each of the cleaning nozzles 17. The heater 78 converts these current pulses into thermal pulses which "pinch" the stream of cleaning fluid ejected from the cleaning nozzles 17 into a droplet of a size which is dependent upon the specific frequency of the current pulses supplied by the power pulse source 80. A specific description of the relationship between frequency, pulse current, and droplet size is given in co-pending U.S. patent Ser. No. 08/954,317 filed Oct. 17, 1997, by the same assignee as this application, Eastman Kodak Company, the entire specification of which is incorporated hereby by reference. Two different modes of operating the embodiments 1, 70 are illustrated in FIGS. 4A and 4B, respectively. In FIG. 4A, the frequency of the current pulses generated by the power pulse source 80 is such that each of the cleaning droplets 17 is somewhat smaller than the orifices 8 of each of the nozzles 3 of the printhead 5. Such a mode of cleaning is particularly effective at dislodging and removing dried ink deposits which may have accumulated in or around the edges of each orifice 4. However, if the frequency of the current pulses is periodically slowed down, cleaning droplets 27 of a larger size may be generated by the droplet sizing mechanism 77. Such a mode of operation is illustrated in FIG. 4B. Here, the cleaning droplets 27 generated are a mixture of small droplets 81*a* having a diameter smaller than that of the orifices 4 of the printing nozzles 3, and larger droplets 81*b* having a diameter about the same as the orifices 4. The smaller droplets 81 are useful for dislodging ink deposits and other debris which have accumulated around the interior walls of the orifice 4. The larger droplets 81*b* are particularly useful for dislodging and removing dried ink deposits and debris which may have accumulated on the surfaces of the nozzles around the edges of the orifices 4. Each of these particular cleaning actions is illustrated in FIGS. 5A and 5B, respectively. Typically the number of drops may lie in the range of from 3 to 10,000, but is not restricted.

Figure 6:
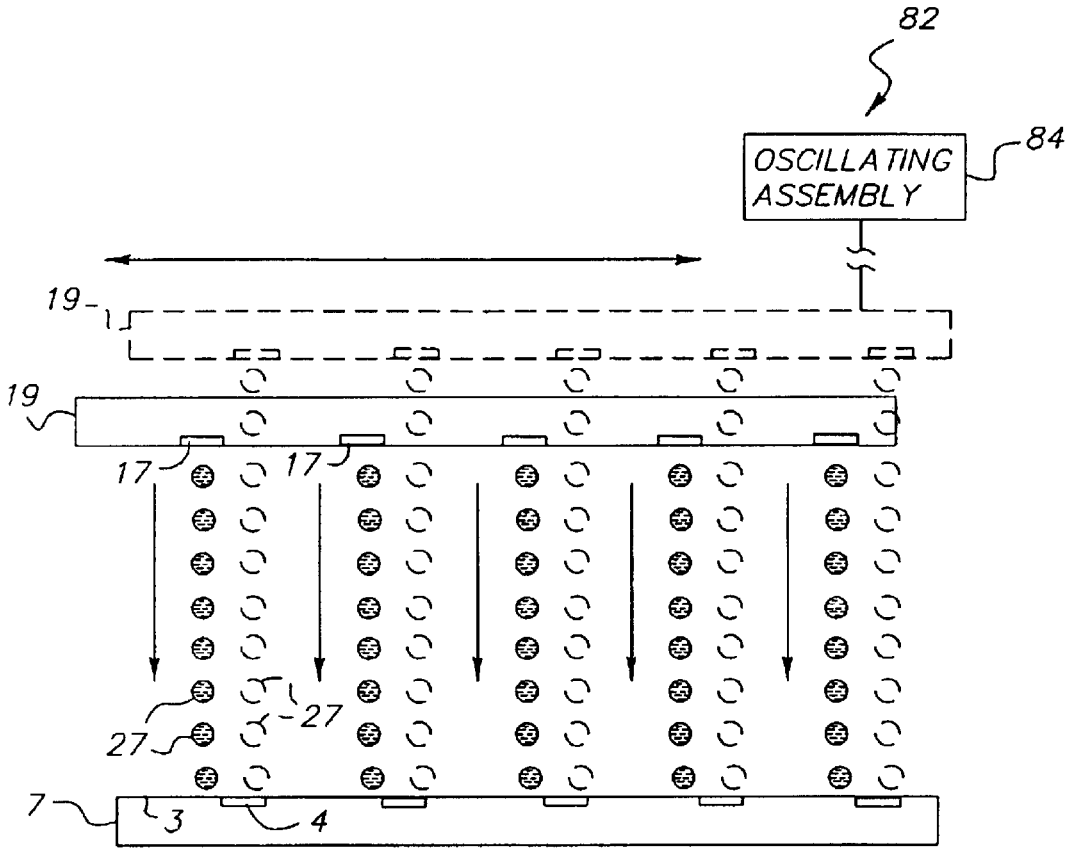
FIG. 6 is a plan, cross-sectional view of the orifice plates of the cleaning head and the printhead illustrating how the cleaning head may be oscillated or dithered during a cleaning operation so that the cleaning droplets impinge on different areas surrounding the nozzles of the inkjet printhead.
Figure 7:
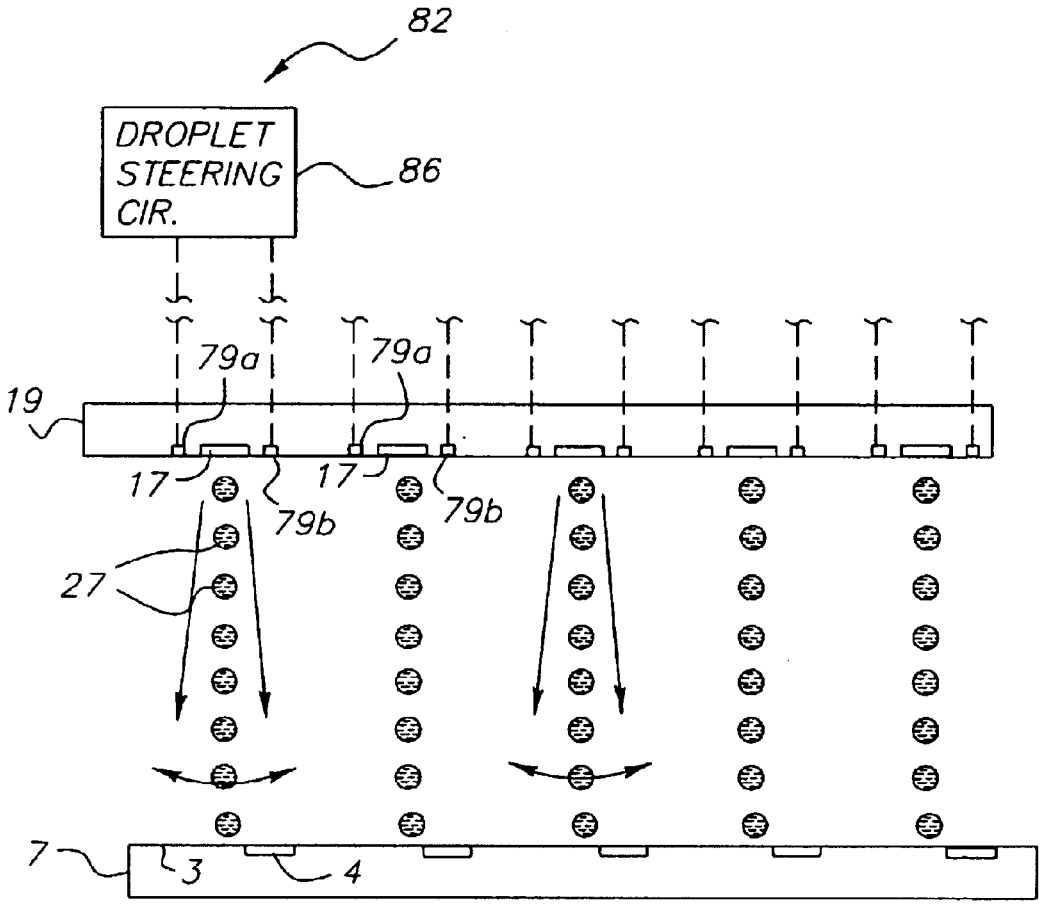
FIG. 7 illustrates an alternative mechanism for changing the location of impingement of the cleaning droplets relative to the nozzles of the printhead wherein thermal steering is used to change the trajectories of the cleaning droplets during the cleaning operation.

In addition to having a droplet sizing mechanism 77, each of the two embodiments 1, 70 of the invention may further include a droplet direction controller 82 as shown in FIG. 6. Controller 82 may take the form of an oscillating assembly 84 which oscillates or reciprocally moves (or "dithers") the cleaning head 15 relative to the printhead 5 so that the cleaning droplets 27 impinge different areas surrounding each of the inkjet nozzles 4. The advantage of such a droplet direction controller 82 is that it allows the narrow streams of high-impact cleaning droplets 27 to more thoroughly clean the areas surrounding the printhead nozzles 4. Alternatively, as shown in FIG. 7, the droplet direction controller 82 may take the form of a droplet steering circuit 86 connected to the two halves 79*a*, 79*b* of the previously described annular heaters 78 also used in the droplet sizing mechanism 77. Here, the droplet steering circuit 86 alternately applies pulses of electrical current to the left half 79*a* and then to the right half 79*b* of the annular heaters 78. The asymmetric application of thermal pulses to the ejected stream of cleaning droplets 27 deflects them first to the left, and then to the right, as indicated. Such thermal steering may also be operated in a manner to better "aim" cleaning droplets which are slightly misdirected due to small misalignments between the printhead 5 and cleaning head 15, or small faults in the cleaning nozzles. Thermal steering is described in detail in U.S. Pat. No. 6,079,821 by J. Chwalek et al and assigned to Eastman Kodak Company, the entire specification of which is expressly incorporated herein by reference. Of these two types of droplet direction controllers 82, the use of a droplet steering circuit 86 in combination with annular heaters 78 having two separate halves 79*a*, 79*b* is preferred, since such a controller 82 can be combined with the previously described droplet sizing mechanism 77, the only difference being that the control circuit connected to the heaters 78 is programmed in one fashion to create cleaning droplets 27 of different sizes when desired, and in another fashion in order to effect the type of thermal steering illustrated in FIG. 7. A third type of droplet direction controller 82 is schematically illustrated in FIG. 1C. Here, a pair of fluid stream generators 88*a*, 88*b* are provided on either side of the orifice plate 19 of the cleaning head 15. In this embodiment, each of the fluid stream generators 88*a*, 88*b* may include a plenum for directing a variable flow of air, which flow is alternated in order to deflect the droplets in the side-to-side manner as is illustrated in FIG. 7. The use of this type of droplet direction controller 82 has the advantages of being relatively easy to implement, and of allowing the heaters 78 to be operated in a droplet sizing mode while simultaneously being deflected from side-to-side, thereby resulting in a somewhat more effective cleaning action than if the heaters 78 are sequentially used as a droplet sizing mechanism 77 in a droplet direction controller 82.

EXAMPLE 1

Figure 8:
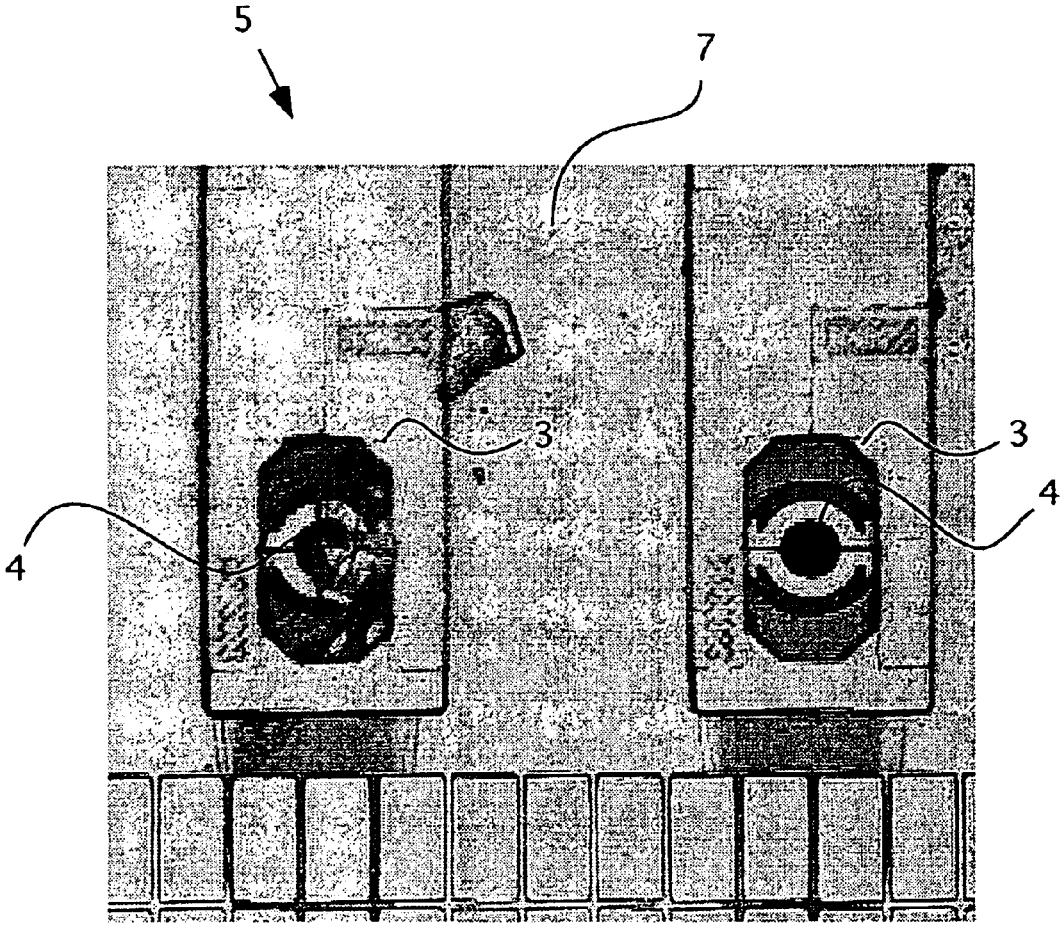
FIG. 8 and FIG. 9 are photographs of an inkjet nozzle before and after the cleaning operation of the invention, respectively.
Figure 9:
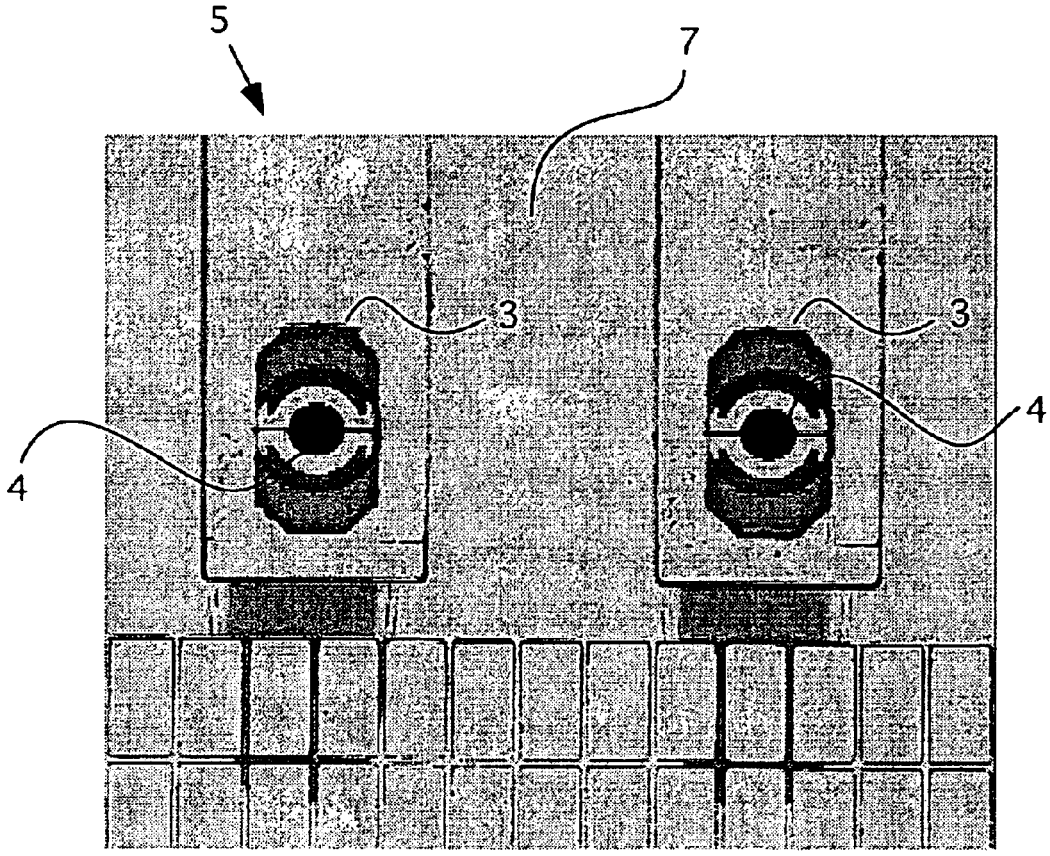

A laboratory prototype of the fluid jet device 1 was used to clean clogged nozzles 3 shown in the enlarged photograph of FIG. 8. The application of cleaning droplets into the orifice 4 of the nozzle 4 from a cleaning head cleaned the nozzle as shown in FIG. 9. The delivery of cleaning fluid through conduit 36 to a separate cleaning head 15 was pressurized via a pump 38 while the cleaning head 15 was placed directly opposite to the printhead 5 to be cleaned. The cleaning head 15 sprayed droplets into the orifice 4 of the printhead 5 to be cleaned. The experiment was conducted at a pressure of 30 psi in conduit 36 with valve 46 in the closed position and then increased to 60 psi in the cleaning printhead 15. Clorox was used as the cleaning fluid. The printhead 5 to be cleaned was operated in a backflush mode using 35 psi water in conduit 62. Valve 68 was alternatively opened and closed every 2 seconds for 2 minutes. As shown in FIG. 8 at the start of the test, the orifice 4 was blocked by a particulate deposit. The result of the cleaning operation is shown in FIG. 9, where the particulate deposit has been removed.

While this invention has been described with respect to several preferred embodiments, persons of skill in the art will recognize that various additions and modifications of the invention might be made to retain or perhaps enhance the advantages associated with the invention. A number of different solvents other than ink may further be used to enhance the cleaning operation, such as a particulate containing liquid, bleach, particulate dry ice, or an organic solvent. All such advantages and modifications are intended to be encompassed within the scope of this invention, which is limited only by the claims appended hereto.

PARTS LISTS

1. Fluid jet device
3. Inkjet nozzles
4. Orifice
5. Printhead
7. Orifice plate
9. Circuit board
11. Rectangular housing
12. Inlet, outlet a, b
13. Mounting assembly
15. Cleaning head
17. Cleaning nozzles
19. Orifice plate
21. Circuit board
23. Rectangular housing
24. Inlet, outlet
25. Mounting assembly -continued

| PARTS LISTS |
|---|
| 27. Cleaning droplets |
| 30. Supply of pressurized cleaning fluid |
| 32. Cleaning fluid reclamation system |
| 34. Closed vessel |
| 35. Cleaning fluid |
| 36. Inlet conduit |
| 38. Pump |
| 39. Pressure controller |
| 40. Distribution plate |
| 42. Outlet conduit |
| 44. Collection vessel |
| 46. Control valve |
| 48. Gutter |
| 50. Drain conduit |
| 52. Drain vessel |
| 54. Drain valve |
| 56. Conduit |
| 58. Filter |
| 60. Recycling pump |
| 62. Inlet conduit |
| 64. Distribution plate |
| 68. Back flush valve |
| 70. Alternative embodiment |
| 71. Auxiliary pump outlet |
| 72. Modulation valve |
| 74. Solvent slug |
| 76. Air |
| 77. Droplet sizing mechanism |
| 78. Annular heaters |
| 79. Heater halves a, b |
| 80. Power pulse source |
| 82. Droplet direction controller |
| 84. Oscillating assembly |
| 86. Droplet steering circuit |
| 88. Fluid stream generators a, b |

What is claimed is:

1. A fluid jet apparatus for cleaning an array of ink jet nozzles in a printhead, wherein each nozzle includes an orifice, comprising:

a cleaning head having an array of cleaning nozzles registrable with said array of ink jet nozzles;

a mounting assembly that mounts said cleaning head in opposition to said printhead with said cleaning nozzles in substantial alignment with said inkjet nozzles, and a supply of pressurized cleaning fluid connected to said cleaning nozzles such that said cleaning nozzles discharge a stream of cleaning droplets that impinge said ink jet nozzles, wherein at least some of said droplets are about the same size as the orifices of the printhead nozzles.

2. The fluid jet apparatus defined in claim 1, further comprising a droplet sizing mechanism that controls the size of fluid droplets discharged by said cleaning nozzles.

3. The fluid jet apparatus defined in claim 2, wherein said droplet sizing mechanism includes a heater adjacent to nozzles of the cleaning head that applies thermal pulses to the stream of fluid discharged by said cleaning nozzles.

4. The fluid jet apparatus defined in claim 1, further comprising a droplet speed controller that controls the velocity and frequency of fluid droplets discharged by said cleaning nozzles.

5. The fluid jet apparatus defined in claim 4, wherein said supply of pressurized cleaning fluid includes a pump, and wherein said droplet speed controller includes a circuit for controlling the amount of pressure that said pump generates in said fluid connected to said cleaning nozzles.

6. The fluid jet apparatus defined in claim 1, further comprising a mechanism for changing a location of impingement of said cleaning fluid droplets with respect to said ink jet nozzles.

7. The fluid jet apparatus defined in claim 6, wherein said location changing mechanism includes a cleaning head moving assembly for oscillating said cleaning head relative to said printhead.

8. The fluid jet apparatus defined in claim 6, wherein said location changing mechanism includes a fluid droplet deflector that deflects a path of fluid droplets discharged from said cleaning nozzles.

9. The fluid jet apparatus defined in claim 8, wherein said location changing mechanism includes a heater adjacent to a side of said cleaning nozzles for asymmetrically supplying a heat pulse to said stream of fluid discharged by said cleaning nozzles.

10. The fluid jet apparatus defined in claim 8, wherein said location changing mechanism includes a device for generating a fluid stream that traverses a path of said fluid droplets to deflect the same.

11. The fluid jet apparatus defined in claim 1, further comprising a cleaning fluid reclamation system that reclaims fluid that impinges the ink jet nozzles.

12. The fluid jet apparatus defined in claim 11, wherein the solvent reclamation system includes a gutter for collecting said cleaning fluid that impinges the ink jet nozzles.

13. The fluid jet apparatus defined in claim 11, wherein the reclamation system includes a pump for generating a negative pressure in the ink jet nozzles during a cleaning operation such that at least some of the cleaning fluid droplets are sucked into the ink jet nozzles.

14. The fluid jet apparatus defined in claim 11, wherein said cleaning fluid is liquid ink used by said printhead to perform a printing operation, and said reclamation system is also an ink reclamation system for said printhead.

15. The fluid jet apparatus defined in claim 1, further comprising a pump for generating a pressure in said ink jet nozzles during a cleaning operation in order to facilitate cleaning.

16. The fluid jet apparatus defined in claim 15, wherein said pump generates a positive pressure for preventing droplets of cleaning fluid from traveling down said ink jet nozzles.

17. A method for cleaning an array of inkjet nozzles in a printhead with a cleaning head having an array of cleaning nozzles registrable with said array of inkjet nozzles each of which includes an orifice, comprising the steps of:

aligning the nozzles of the cleaning head with the nozzles of the printhead, and discharging a stream of droplets of cleaning fluid from said cleaning head toward said printhead such that said cleaning droplets impinge said nozzles of said printhead to clean the same.

18. The method according to claim 17, wherein at least some of said cleaning droplets are about the same size as the orifices.

19. The method of claim 17, further comprising the step of controlling the speed and frequency of said droplets of cleaning fluid.

20. The method of claim 19, wherein said speed and frequency of said cleaning droplets is controlled by controlling a pressure of a supply of cleaning fluid connected to said cleaning head.

21. The method of claim 17, further comprising the step of controlling the size of said cleaning droplets impinging said printhead nozzles.

22. The method of claim 21, wherein said size of said cleaning droplets is controlled by the application of thermal pulses to said discharged stream of cleaning fluid.

23. The method of claim 17, further comprising the step of changing a direction of said cleaning droplets such that said cleaning droplets impinge different areas of said printhead nozzles during said cleaning method.

24. The method of claim 23, wherein said change of direction of said cleaning droplets is implemented by moving said cleaning head during said cleaning method.

25. The method of claim 24, wherein said cleaning head is oscillated during said cleaning method.

26. The method of claim 23, wherein said change of direction of said cleaning droplets is implemented by the application of asymmetric thermal pulses to said discharged stream.

27. The method of claim 23, wherein said change of direction of cleaning droplets is implemented by the application of a variable flow of fluid transverse to a direction of discharge of said stream of cleaning droplets.

28. The method of claim 27, wherein said variable fluid flow is a stream of air.

29. The method of claim 27, wherein said variable fluid flow is a film of liquid.

30. The method of claim 17, wherein said stream of cleaning droplets is discharged continuously during the cleaning method.

31. The method of claim 17, wherein said stream of cleaning droplets is discharged on demand during the cleaning method.

32. The method of claim 31, wherein said demand discharge of said cleaning droplets is implemented by alternately supplying a slug of cleaning fluid and a flow of compressed air to said cleaning nozzles of said cleaning head.

33. The method of claim 17, wherein said cleaning fluid is one of the group consisting of a liquid solvent, a liquid ink, and particulate dry ice.

* * * * *